US009415289B1

(12) United States Patent
Vassallo

(10) Patent No.: US 9,415,289 B1
(45) Date of Patent: Aug. 16, 2016

(54) SWIMMING DEVICE

(71) Applicant: Vassallo Underwater LLC, Boca Raton, FL (US)

(72) Inventor: Jesus D. Vassallo, Boca Raton, FL (US)

( * ) Notice: Subject to any disclaimer, the term of this patent is extended or adjusted under 35 U.S.C. 154(b) by 24 days.

(21) Appl. No.: 13/844,959

(22) Filed: Mar. 16, 2013

Related U.S. Application Data

(60) Provisional application No. 61/612,004, filed on Mar. 16, 2012.

(51) Int. Cl.
*A63B 31/00* (2006.01)
*A63B 69/12* (2006.01)
*A63B 31/10* (2006.01)

(52) U.S. Cl.
CPC ..... *A63B 69/12* (2013.01); *A63B 31/00* (2013.01); *A63B 31/10* (2013.01)

(58) Field of Classification Search
CPC ..... A63B 21/00134; A63B 21/065; A63B 21/1449; A63B 31/00; A63B 31/08; A63B 31/10; A63B 31/11; A63B 31/12; A63B 31/18; A63B 69/0059; A63B 69/10; A63B 69/12; A63B 67/007; A63B 21/0016; A63B 21/0017; A63B 21/00174; A63B 21/1426; A63B 21/1442; A63B 21/1484; A63B 21/14; A63B 21/0084; A63B 225/60; A63B 225/0605; A63B 225/62; A63B 2225/60; A63B 2225/0605; A63B 2225/62; A63B 2208/03; B63C 9/08; B63C 9/081; B63C 9/082; B63C 9/13; B63C 9/135; B63C 9/15; B63C 9/155; A41D 13/012; A41D 13/0125; A41D 20/00; A41D 20/005
USPC ..... 482/55, 110–113, 139; 441/108, 122, 441/123, 129, 131, 55, 56, 59–61; 602/13; 2/338, 170, 59, 60, 910, 917
See application file for complete search history.

(56) References Cited

U.S. PATENT DOCUMENTS 1,663,268 A * 3/1928 Foley ..... B63C 9/155 441/91
2,127,926 A * 8/1938 Mason ..... A41D 20/00 2/170
2,276,072 A * 3/1942 Stokes ..... A41D 13/0125 441/109
2,638,599 A * 5/1953 Flink ..... A41D 13/088 128/DIG. 23
4,549,871 A * 10/1985 Verney ..... B63C 9/082 441/81
4,804,326 A * 2/1989 Lennon ..... B63C 9/15 434/254
4,936,804 A * 6/1990 Dowdeswell ..... 441/6
5,250,345 A * 10/1993 Chu ..... 428/156

(Continued)

*Primary Examiner* — Oren Ginsberg
*Assistant Examiner* — Gregory Winter
(74) *Attorney, Agent, or Firm* — Marc A. Hubbard; Hubbard Law, PLLC

(57) ABSTRACT

A device made of an elastomeric material formed in a circular or elliptical or oval shape having an exterior surface and an interior surface and a non-uniform thickness, with opposing ends having a decreased thickness. The interior surface may include one or more slip resistant elements. The exterior of the device may also include at least one slip resistant element as well as one or more artistic or design elements or overlays. The device is lightweight and may be made more buoyant with one or more air pockets or air spaces located between the exterior and the interior surfaces and walls forming the surfaces. In operation, one or more devices are removably and adjustably positioned around an extremity portion of a person, such as both ankles, both feet, both calves, both knees, both thighs, both hands, both wrists, both lower arms, both upper arms, or both elbows.

16 Claims, 3 Drawing Sheets

(56) References Cited

U.S. PATENT DOCUMENTS 5,700,173 A * 12/1997 Lerro ..... A63B 31/08 441/57
5,873,130 A * 2/1999 Lafferty ..... A41D 13/088 2/159
6,520,893 B2 * 2/2003 Bray ..... 482/140
7,001,350 B2 * 2/2006 Grosso ..... 602/19
D622,476 S * 8/2010 Babbitt ..... D2/610
8,376,914 B2 * 2/2013 Avrett ..... A63B 21/0606 441/129
2009/0325436 A1 * 12/2009 Messina ..... B63C 9/135 441/88
2011/0098615 A1 * 4/2011 Whalen ..... A63B 21/00181 601/151

* cited by examiner

SWIMMING DEVICE

CROSS REFERENCE TO RELATED APPLICATION

This application claims the benefit of U.S. provisional application No. 61/612,004, filed Mar. 16, 2012, entitled "Swimming Device," which is incorporated herein in its entirety by reference for all purposes.

BACKGROUND

An elastomeric device for training while in the water. Such a device that is portable, light weight, cost effective and ready to use is desired.

OVERVIEW

Described herein is a device for improving swim performance. The device can be used in any water environment and is portable. The device generally consists of an elastomeric material formed in a circular or elliptical or oval shape having a non-uniform thickness, wherein its opposing ends have a decreased thickness as compared with any region that is some distance from the ends. The device has an exterior surface and an interior surface. The interior surface may include one or more slip resistant element. The exterior of the device may also include a slip resistant element, such as concentric ribs, as well as one or more artistic or design elements or overlays, such as an embossment or debossment or other surface overlay that may be otherwise in contact with or adhering to the exterior surface. The surface contact may be permanent or temporary.

The device is lightweight and may be made more buoyant with one or more air pockets or air spaces located between the exterior and the interior surfaces and walls forming said surfaces.

In operation, the device is removably and adjustably positioned around an extremity portion of a person. The device may be positioned around the ankles, the feet, the calves, the knees, the thighs, etc. The device is also removably and adjustably positioned around an upper extremity portion of a person or an upper extremity portion of a person, such as the hands, wrists, lower arms, elbows or upper arms.

In one form, the device is sized and shaped for positioning around both ankles, keeping the ankles in a close relationship and limiting movement of the ankles, thereby allowing for a training advantage for a swimmer. In another form, the device is sized and shaped for positioning around both wrists or elbows, keeping the wrists or elbows in a close relationship and limiting movement of the wrists or elbows, thereby allowing for a training of the mid and lower extremities of the body.

As described herein is an elastomeric device comprising a shaped member having an interior surface and an exterior surface, wherein the shape of the member is selected from the group consisting of substantially oval, substantially circular, and substantially elliptical; and one or more slip resistant elements positioned along the interior surface of the shaped member. The one or more slip resistant elements may be ribs. The ribs may be positioned along the full circumference of the shaped member. The shaped member may have a circumference of about 14.5 inches and a width of about 2.5 inches and a thickness of about ⅛ inch. The shaped member may have a circumference of 12.5 inches and have a width of about 1.5 inches and a thickness of about 1/16 inch. The shaped member may have a circumference of 16.5 inches and have a width of about 4.5 inches and a thickness of about ¼ inch. The exterior surface may further comprise one or more from the group consisting of embossment, debossment, and design overlay. The shaped member may include one or more spaces between the exterior surface and the interior surface. The shaped member is made of an elastomeric material.

Still further is described an elastomeric device comprising a shaped member having an interior surface and an exterior surface and opposing ends, wherein the shape of the member is selected from the group consisting of substantially oval, substantially circular, and substantially elliptical, wherein the exterior surface is curvilinear and the interior surface is not curvilinear, and wherein each of the opposing ends have a reduced thickness as compared with a region located a distance away from the opposing ends, and one or more slip resistant elements positioned along the interior surface of the shaped member. The one or more slip resistant elements are ribs extending away from the interior surface and positioned along the circumference of the shaped member. The shaped member may have a circumference of about 10 inches to about 18 inches. The shaped member may have a width of about one inch to about five inches. The shaped member may have a thickness of about 1/16 of an inch to about ½ inch. The exterior surface may further comprises one or more from the group consisting of embossment, debossment, and design overlay. The shaped member may include one or more air-filled spaces between the exterior surface and the interior surface. The shaped member is made of an elastomeric material.

In further embodiments are described a method of using an elastomeric device comprising: positioning the elastomeric device around a portion of the lower extremity of the body, wherein the portion of the lower extremity of the body is selected from the group consisting of both ankles, both feet, both calves, both knees, and both thighs, wherein positioning of the elastomeric device includes having a slip resistance surface of the elastomeric device that is on its interior and in contact with the portion of lower extremity of the body, and wherein positioning of the elastomeric device maintains the lower extremity in a fixed position limiting movement of the lower extremity of the body. The positioning of the elastomeric device generally maintains buoyancy of the portion of the lower extremity of the body. The method may further comprise combining positioning of the elastomeric device with placement of a pull buoy for proper alignment of the lower extremity of the body.

In further embodiments are described a method of using an elastomeric device comprising: positioning the elastomeric device around a portion of the upper extremity of the body, wherein the portion of the upper extremity of the body is selected from the group consisting of both hands, both wrists, both lower arms, both elbows, and both upper arms, wherein positioning of the elastomeric device includes having a slip resistance surface of the elastomeric device that is on its interior and in contact with the portion of lower extremity of the body, and wherein positioning of the elastomeric device maintains the upper extremity in a fixed position limiting movement of the upper extremity of the body. The positioning of the elastomeric device may maintain buoyancy of the portion of the upper extremity of the body. The method may further comprise combining positioning of the elastomeric device with placement of a pull buoy for proper alignment of the upper extremity of the body.

These and other embodiments and features and the advantages thereof, will become readily apparent from the following description, taken in conjunction with any exemplary representations, drawings and/or example.

BRIEF DESCRIPTION OF THE DRAWINGS

For more complete understanding of the features and advantages described herein, reference is now made to a description along with accompanying figures, wherein.

DETAILED DESCRIPTION

Figure 1A:
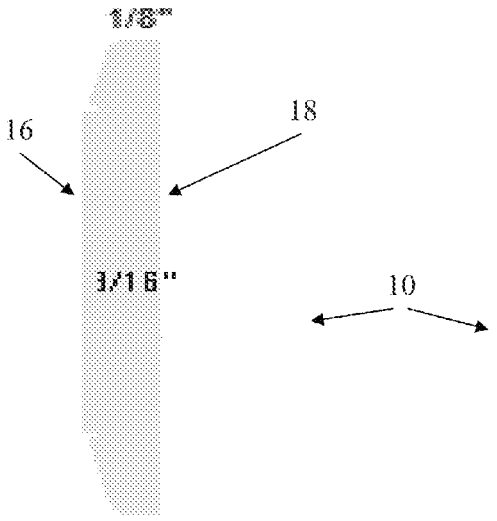
FIGS. 1A and 1B are each a representative thin section of a device described herein.

Although making and using various embodiments are discussed in detail below, it should be appreciated that as described herein are provided many inventive concepts that may be embodied in a wide variety of contexts. Embodiments discussed herein are merely representative and do not limit the scope of the invention.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

Generally, described herein is a tubular member, the shape in cross section (from a top view) having a generally circular or elliptical or oval appearance. The length (L) of the member (which will be represented as a circumference due to its shape) will be more than its width as depicted in FIG. 2. The thickness of the device is not uniform as depicted in FIGS. 1A and 1B; the ends of the device will be thinner than the mid portion of the device.

Figure 1B:
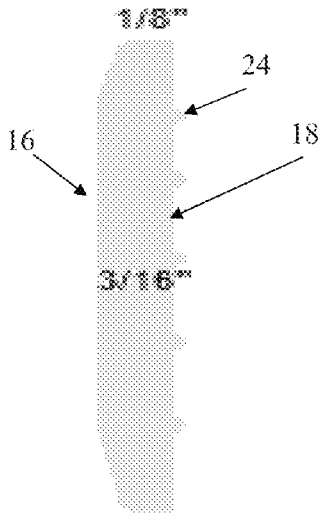
Figure 2:
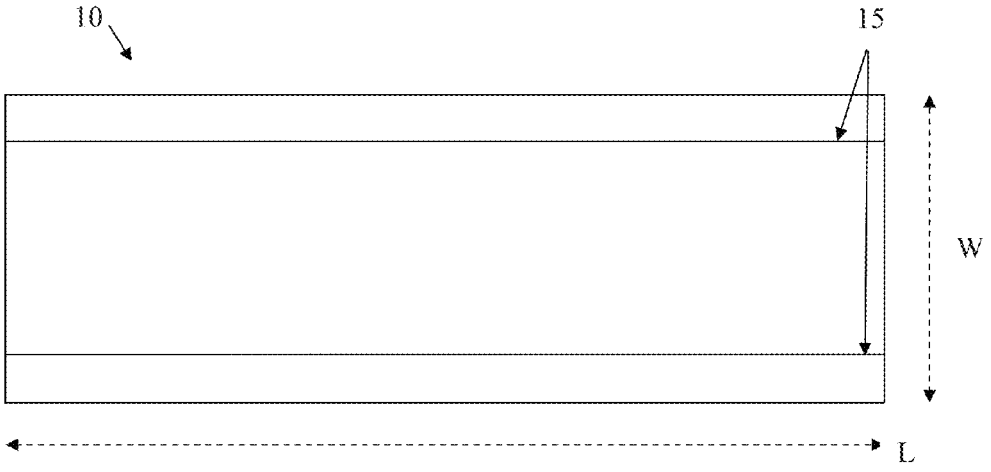
FIG. 2 is a front view of the device of FIG. 1A or FIG. 1B, showing only about half of the device.
Figure 3:
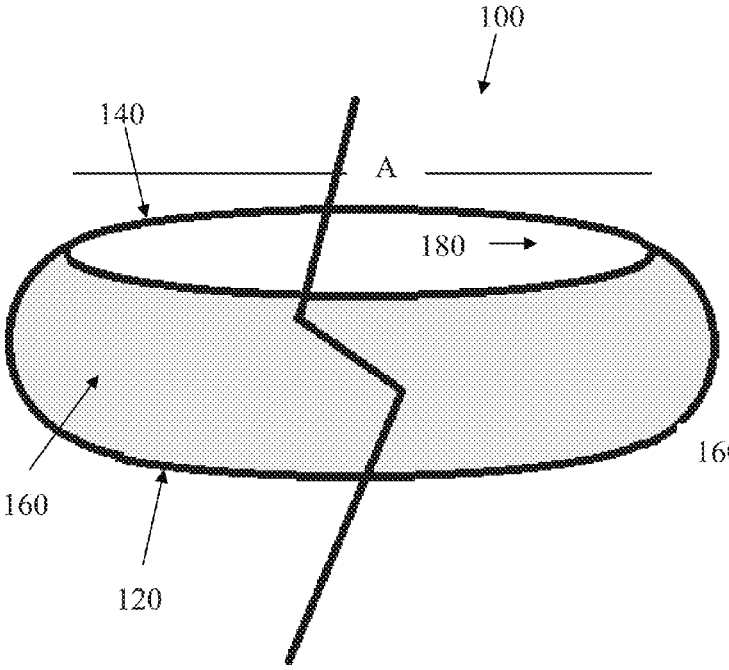
FIG. 3 is representative view in perspective of another device described herein.

As shown in FIGS. 1A and 1B, the device 10 will have an exterior surface 16 and an interior surface 18. While the interior surface may be planar (e.g., FIG. 1A), the exterior surface is dimensioned such that it is curvilinear at or near its ends and somewhat planar near its mid region.

The circumference of a member 10 may be of any suitable amount, from less than or about 10 inches to about 12.5 inches to about 14.5 inches to about 16.5 inches to greater than about 16.5 inches. While a member depicted herein may have a different circumference than what it described, the additional size may not improve performance to a much greater extent than what has been found with a member that has a circumference of up to about 18 inches. The thickness of a member 10 may, in one form be about ⅛ inch at its ends and 3/16 of an inch in its mid region, as viewed when cut as a thin section, depicted in FIGS. 1A and 1B. The width (W) of member 10 may be 1 inch wide or may be about 1½ inches wide or may be about 2 inches wide or about 2½ inches wide or may be about 3 inches wide or may be about 4 inches wide or may be about 4½ inches wide.

Figure 5:
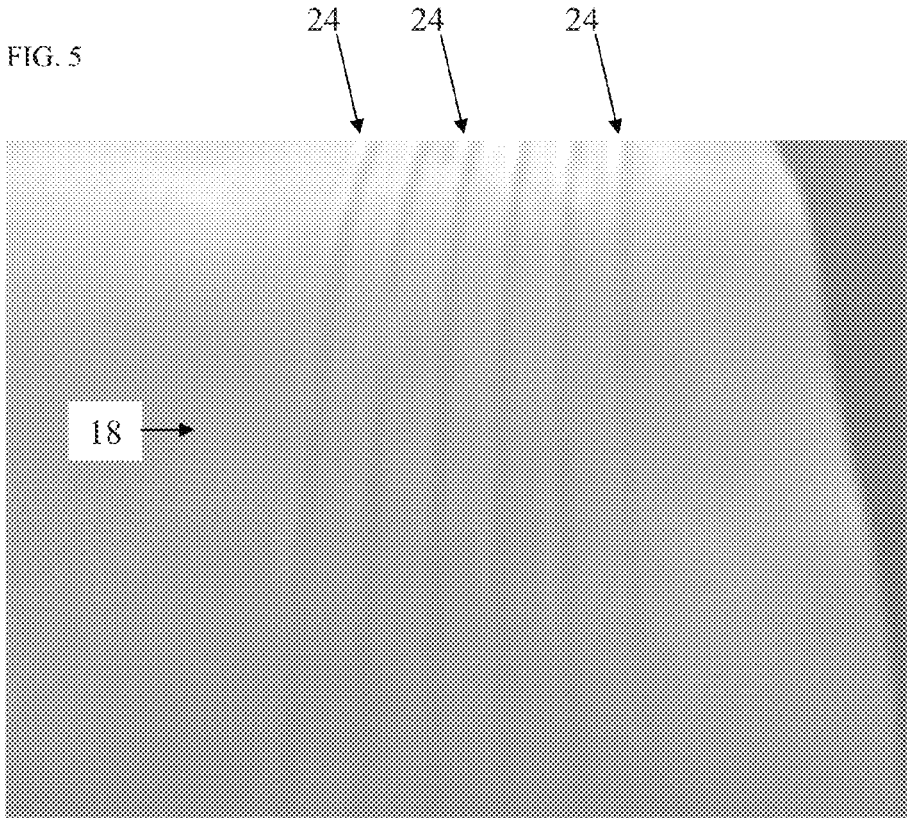
FIG. 5 is a view of the interior surface of the device of FIG. 1.

The interior surface 18 of member 10 may include one or more continuous or substantially continuous slip resistant members or embossments or ribs 24 as depicted in FIGS. 1B and 5. In some embodiments, the ribs may be evenly spaced apart along the entire width of the interior surface (FIG. 1B). In other embodiments, the ribs may be more focused on one end of the member, as shown in FIG. 5.

In some embodiments, the exterior surface of member 10 may further include one or more designs or embedded or overlayed (debossed or embossed) elements that are placed for an artistic purpose and/or for a commercial purpose (e.g., embedded lines 15 as depicted in FIGS. 1A and 2). Such elements may be adhered to the device after it is formed or may be included during the formation process (e.g., when molding). Such elements may be adhered in order for them to remain for a long period of time or may be placed for only temporary use, as desired.

Figure 4:
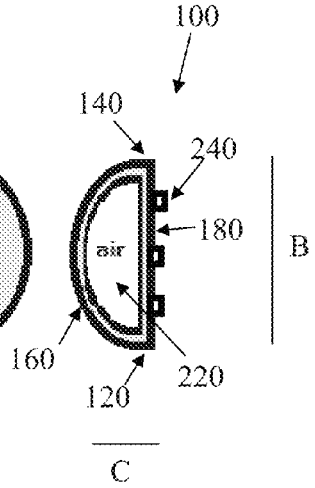
FIG. 4 is thin section of the device of FIG. 3.

In addition or as an alternative a member 100 is described, which has an exterior continuous side wall with an exterior surface 160 and an interior continuous side wall with an interior surface 180. In some embodiments, as depicted in FIG. 4, the exterior surface 160 may have a more curvilinear shape and the interior surface may have a more linear or planar shape. Because of its shape, the length of member 100 is guided by its circumference. The circumference of a member 100 may be of any suitable amount, from less than or about 10 inches to about 12.5 inches to about 14.5 inches to about 16.5 inches to greater than about 16.5 inches. While a member depicted herein may have a different circumference than what it described, the additional size may not improve performance to a much greater extent than what has been found with a member that has a circumference of up to about 18 inches.

Either or both exterior surface 160 and interior surface 180 of member 100 may be continuous or optionally discontinuous. One or more small gaps, ribs, overlays, embossments or debossments may be positioned on either of said surfaces. For example, the interior surface 180 may include one or more continuous or substantially continuous slip resistant members or embossments or ribs 240 as depicted in FIG. 4. In some embodiments, the ribs may be evenly spaced apart along the entire width of the surface. In other embodiments, the ribs may be more focused on one end of the member or both ends of the member 100. In some embodiments, the exterior surface may further include one or more designs or embedded or overlayed elements that are placed for an artistic purpose and/or for a commercial purpose. Such elements may be adhered to the device after it is formed or may be included during the formation process. Such elements may be adhered in order for them to remain for a long period of time or may be placed for only temporary use, as desired.

Member 100 has two opposing ends. The opposing ends, namely end 120 and end 140, are a distance apart, signified by B in FIG. 4. B may be any of a number of distances. B may generally be up to about 5 inches wide. While wider members may be made, they will not often improve performance more than that found with a member that is about 5 inches wide or less. In some embodiments, B may be about 1 inch wide or may be about 1½ inches wide or may be about 2 inches wide or about 2½ inches wide or may be about 3 inches wide or may be about 4 inches wide or may be about 4½ inches wide.

Each end of member 100 is generally of a smaller thickness than a region that is a distance away from the end, as depicted in FIG. 4. The change in thickness may be because there is more material in the thicker regions located away from the opposing ends or because of one or more space formations located in one or more regions away from the ends of member 100. FIG. 4 depicts a single air-filled space in member 100. However, the number and position and constituent of the spaces may vary as desired. In some embodiments, the spaces may very small, like bubbles. In some embodiments, the space may be filled with a gas other than air. The space may be continuous along the entire circumference of member 100. In some embodiments, the space does not have to be continuous along the entire circumference of member 100.

Member 10 and/or member 100 may be formed from a single molded material or may be a bonding of two members, such as one member that comprises the exterior side wall and one member that comprises the interior side wall. As a single molding, ribbings or embossments or debossments may optionally be included in the mold. With bonding, more than one member may be united to provide a multi-member device. Bonding may be a melt bonding, thermal bonding, ultrasonic bonding, mechanical stitching, and the like. In some embodiments, member 10 and/or member 100 may also include a laminate of layers, of which one of skill in the art will understand how to make. Member 10 and/or member 100 may also include ribbing(s) made of a material with a different, or higher mechanical resistance (or stiffer property), than the member itself.

When the device is made from more than one elastomeric member or more than one elastomeric material, adjacent elastomeric materials may be connected with a layer of adhesive, or by another bonding process known in the art, such as thermal bonding, ultrasonic bonding, chemical crosslinking, and mechanical lamination, as suitable examples. The adjacent materials may be bonded together along their entirety or may be bonded at one or more regions (thereby forming one or more spaces or gaps) or may be bonded only at edges which may or may not overlap each other.

The elastomeric material may be somewhat permeable to moisture vapor and/or liquid water or may be relatively impermeable to moisture vapor and/or liquid water, or may have a specific permeability to moisture vapor and/or liquid water depending on whether the device is to be used in salt water or chlorinated water or other type of water.

Elastic polymers suitable for preparing the elastomeric member are those that can be stretched while returning to generally the same original shape. The device is not developed for resistance exercise so highly stretchable materials are not as suitable as those that are stronger with a lower resilience. Useful elastomers include but are not limited to silicone, rubber (polyisoprene), polychloroprene, polybutadiene, polyisobutylene, or copolymers or block copolymers that contain one or more elastomer (e.g., ethylene propylene, poly(styrene-butadiene), polyamide). The examples are not designed to be limiting but to serve as representative examples.

Processing aids may be added to the elastomeric material to assist in producing the elastomer. Suitable processing aids are known by one skilled in the art and include, but are not limited to, a polyolefin processing aid. Others include polyethylene, polypropylene, and polybutene and known copolymers (e.g., ethylene copolymers, propylene copolymers and butene copolymers). Some of the latter processing aids may have a negative effect on the hysteresis of the base elastomer. Hysteresis is a measure of how well an elastic material retains its elastic properties over a number of stretch cycles. Processing aids that have a more negative effect on the hysteresis of the base elastomer may be avoided when desired.

In operation, the device when formed is adjustably positioned to a desired region around an extremity of a person. One or more devices may be positioned as desired. The device (s) may be positioned around a portion of the lower extremity, such as the ankles, or both feet, or both calves, or both knees, or both thighs, etc. The circumference of the device may be modified or pre-selected in advance to suit the desired location for positioning the device. The device should be of a selected circumference that allows close positioning of the two ankles, or the two feet, or the two calves, or the two knees, or the two thighs, preventing any large displacement between the two ankles, or two feet, or two calves, or two knees, or two thighs, respectively.

The device(s) may be also be positioned around a portion of the upper extremity, such as the hands, or both wrists, or both lower arms, or both elbows, or both upper arms, etc. The circumference of the device may be modified or pre-selected in advance to suit the desired location for positioning the device. The device should be of a selected circumference that allows close positioning of the two hands, or the two wrists, or the two lower arms, or the two elbows, or the two upper arms preventing any large displacement between the two hands, or two wrists, or two lower arms, or two elbows, or two upper arms, respectively.

While the device may have some buoyancy, the device may also be used in combination with one or more flotation devices (e.g., pull buoy) in order to maintain the body in proper alignment during swimming.

In one form, the device is a silicone device, molded of single silicone material, with ribbing on the interior surface to provide slip resistance and is sized and shaped for positioning around both ankles, keeping the ankles in a close relationship, proximate to each other, and limiting movement of the ankles, thereby allowing for a training advantage for a swimmer.

A suitable size device for use around both legs (e.g., at the calf or ankle) may have a circumference of about 14.5 inches and have a width of about 2.5 inches and a thickness of about ⅛ inch (at its thinnest portion) and thickness of about $3/16^{th}$ of an inch (at its thickest portion). Another suitable device may have a circumference of 12.5 inches and have a width of about 1.5 inches and a thickness of about 1/16 inch. Another suitable device may have a circumference of 16.5 inches and have a width of about 4.5 inches and a thickness of about ¼ inch.

In another form, the device is a silicone device, molded of single silicone material, with ribbing on the interior surface to provide slip resistance and is sized and shaped for positioning around both wrists or both elbows, keeping the wrists or elbows in a close relationship, proximate to each other, and limiting movement of the wrists or elbows, thereby allowing for training of the lower extremity.

Although representative processes and articles have been described in detail herein, those skilled in the art will recognize that various substitutions and modifications may be made without departing from the scope and spirit of what is described and defined by the appended claims.

What is claimed is:

1. An elastomeric device for training a swimmer to improve the swimmer's performance, comprising:

a shaped member comprised of elastomeric material defining an opening, the shaped member having an interior surface facing the opening and an exterior surface, wherein the shape of the shaped member is selected from the group consisting of substantially oval, substantially circular, and substantially elliptical, wherein the interior surface is planar and the exterior surface is curvilinear, wherein the shaped member has a hollow center filled with air, and wherein the cross-sectional shape of the shaped member is the same around its entire circumference; and one or more slip resistant elements positioned along the interior surface of the shaped member;

wherein the shaped member has a preselected circumference equal to or less than 18 inches when not stretched, which closely fits around and positions two body appendages of the swimmer when wearing the elastomeric device, thereby preventing a displacement between the two body appendages, the two body appendages selected from the group consisting of: two hands, two wrists, two lower arms, two elbows, and two upper arms of the swimmer.

2. The elastomeric device of claim 1, wherein the one or more slip resistant elements are ribs.

3. The elastomeric device of claim of 2, wherein the ribs are positioned along the circumference of the shaped member.

4. The elastomeric device of claim 1, wherein the preselected circumference of the shaped member is about 14.5 inches and the shaped member has a width of about 2.5 inches and a thickness of about ⅛ inch.

5. The elastomeric device of claim 1, wherein the preselected circumference of the shaped member is 12.5 inches and the shaped member has a width of about 1.5 inches and a thickness of about 1/16 inch.

6. The elastomeric device of claim 1, wherein the preselected circumference of the shaped member is 16.5 inches and the shaped member has a width of about 4.5 inches and a thickness of about ¼ inch.

7. The elastomeric device of claim 1, wherein the exterior surface further comprises one or more from the group consisting of embossment, debossment, design and overlay.

8. The elastomeric device of claim 1, wherein the shaped member includes one or more spaces between the exterior surface and the interior surface.

9. An elastomeric device comprising:

a continuous tubular shaped member comprised of elastomeric material defining an opening, the shaped member having an interior surface facing the opening and an exterior surface, wherein the shape of the shaped member is selected from the group consisting of substantially oval, substantially circular, and substantially elliptical, and wherein the exterior surface is curvilinear and the interior surface is generally planar; and one or more slip resistant elements positioned along the interior surface of the shaped member;

wherein the continuous tubular shaped member has a preselected circumference equal to or less than 18 inches when not stretched for closely fitting around and positioning two body members of a swimmer when wearing the elastomeric device, thereby preventing any large displacement between the two members, the two members selected from the group consisting of: two hands, two wrists, two lower arms, two elbows, and two upper arms of the swimmer; and wherein the tubular shaped member has a consistent cross-sectional shape along its entire circumference and has a hollow center filled with air.

10. The elastomeric device of claim 9, wherein the one or more slip resistant elements are ribs extending away from the interior surface and positioned along the circumference of the shaped member.

11. The elastomeric device of claim 9, wherein the preselected circumference of the shaped member is about 10 inches to about 18 inches.

12. The elastomeric device of claim 9, wherein the shaped member has a diameter of about one inch to about five inches.

13. The elastomeric device of claim 9, wherein the shaped member has a thickness of about 1/16 of an inch to about ½ inch.

14. The elastomeric device of claim 9, wherein the exterior surface further comprises one or more from the group consisting of embossment, debossment, and design overlay.

15. An elastomeric swim training device for improving performance of a swimmer comprising:

a continuous, tubular member molded as a single piece of silicone material defining an opening through which two body members of the swimmer may be inserted; and ribbing integrally formed on an exterior surface of the continuous, shaped member that faces inwardly, toward the opening, the exterior surface that faces inwardly, toward the opening, having a flat portion for engaging the body members when they are inserted through the opening;

wherein the continuous, tubular member has a circumference equal to or less than 18 inches when not stretched and a shape for, when positioned around the two body members of the swimmer, keeping the body members in a close relationship proximate to each other and limiting movement of the body members, thereby allowing for a training advantage for the swimmer when wearing the elastomeric device; and wherein the cross-sectional shape of the continuous, tubular member has a hollow center filled with air, and is consistent and has the same dimensions along its entire circumference.

16. The elastomeric device of claim 15, wherein the exterior surface further comprises one or more from the group consisting of embossment, debossment, design and overlay.

* * * * *